US010378169B2

(12) United States Patent
Hamilton

(10) Patent No.: US 10,378,169 B2
(45) **Date of Patent: *Aug. 13, 2019**

(54) HYDRAULIC POLE TAMPER HANDLE ASSEMBLY AND ADAPTER KIT

(71) Applicant: Timothy Hamilton, New Haven, KY (US)

(72) Inventor: Timothy Hamilton, New Haven, KY (US)

( * ) Notice: Subject to any disclaimer, the term of this patent is extended or adjusted under 35 U.S.C. 154(b) by 2 days.

This patent is subject to a terminal disclaimer.

(21) Appl. No.: 15/646,374

(22) Filed: Jul. 11, 2017

(65) Prior Publication Data

US 2018/0016764 A1 Jan. 18, 2018

Related U.S. Application Data

(63) Continuation-in-part of application No. 14/121,646, filed on Oct. 2, 2014, now Pat. No. 9,777,453.

(60) Provisional application No. 62/493,940, filed on Jul. 21, 2016.

(51) Int. Cl.

| | |
|---|---|
| ***B25D 17/04*** | (2006.01) |
| ***E02D 3/068*** | (2006.01) |
| ***E02D 13/00*** | (2006.01) |
| ***E02D 5/22*** | (2006.01) |
| ***E02D 3/046*** | (2006.01) |
| ***E01C 19/35*** | (2006.01) |
| ***E04H 12/34*** | (2006.01) |

(52) U.S. Cl.

CPC ..... *E02D 3/068* (2013.01); *E01C 19/35* (2013.01); *E02D 3/046* (2013.01); *E02D 5/22* (2013.01); *E02D 13/00* (2013.01); *E04H 12/347* (2013.01)

(58) Field of Classification Search

CPC ..... B25D 17/043; E02D 3/046; A01B 1/026; A01B 1/22

USPC ..... 74/557; 294/57, 58

See application file for complete search history.

(56) References Cited

U.S. PATENT DOCUMENTS

| | | | | | |
|---|---|---|---|---|---|
| 1,470,622 | A * | 10/1923 | Jimerson | B25D 9/08 | 104/14 |
| 1,653,080 | A * | 12/1927 | Zimmermann | B25D 9/14 | 173/171 |
| 1,802,166 | A * | 4/1931 | Bergmann | B25G 3/02 | 294/57 |
| 2,551,925 | A * | 5/1951 | Brown | E01C 19/35 | 173/169 |
| 2,884,842 | A * | 5/1959 | Schmitz | E01C 19/35 | 173/131 |
| 2,942,589 | A * | 6/1960 | Wacker | E02D 3/068 | 173/118 |
| 3,857,448 | A | 12/1974 | Lines | | |
| 4,102,410 | A * | 7/1978 | Ross | B25D 17/08 | 173/118 |
| 4,457,472 | A | 7/1984 | Geberth, Jr. | | |

(Continued)

*Primary Examiner* — Andrew M Tecco
*Assistant Examiner* — Eyamindae Jallow
(74) *Attorney, Agent, or Firm* — Carrithers Law Office PLLC; David W. Carrithers

(57) ABSTRACT

A hydraulic pole tamper handle kit having an extended ergonomic handle including a frame and hose clamps to extend the life of the hose by securing the hoses to the frame and to improve the handle, orientation, safety, and usability of the pole tamper. The pole tamper is used to tamp or compact the dirt around a pole which has been set into a hole in the ground to fixedly secure the pole vertically in the ground.

21 Claims, 4 Drawing Sheets

(56) References Cited

U.S. PATENT DOCUMENTS

| | | | | |
|---|---|---|---|---|
| 5,947,211 | A * | 9/1999 | Jakobsson | B25D 17/043 173/162.1 |
| 6,112,831 | A * | 9/2000 | Gustafsson | B25D 17/043 173/162.2 |
| 6,244,557 | B1 * | 6/2001 | Maze | A45B 11/00 248/214 |
| 6,580,442 | B1 * | 6/2003 | Singh | G06F 3/0482 345/173 |
| 6,732,982 | B1 * | 5/2004 | Messinger | F16L 3/1233 24/16 PB |
| 8,161,605 | B2 * | 4/2012 | Reichel | F16L 3/123 24/20 R |
| 8,235,332 | B2 * | 8/2012 | Cesarino | B60R 16/0215 248/65 |
| 8,414,221 | B2 | 4/2013 | Faucher | |
| 9,248,967 | B1 * | 2/2016 | Gregg | A62C 33/04 |
| 2001/0007387 | A1 * | 7/2001 | Gomez | B62B 1/125 280/47.17 |
| 2012/0312572 | A1 | 12/2012 | Nemetz | |

* cited by examiner

HYDRAULIC POLE TAMPER HANDLE ASSEMBLY AND ADAPTER KIT

CROSS REFERENCES TO RELATED APPLICATIONS

This application is a Continuation-In-Part of U.S. application Ser. No. 14/121,646 filed on Oct. 2, 2014 and claims priority from U.S. Provisional Application Ser. No. 62/493,940 filed on Jul. 21, 2016 both of which are incorporated by reference herein in their entirety.

TECHNICAL FIELD

The present invention relates to the field of hydraulic tamping devices used to tamp fill material tightly around a pole set into a post hole in the ground.

BACKGROUND OF THE INVENTION

Wooden utility poles and/or telephone poles are often over forty feet tall and must therefore be set in a deep hole in the ground for stability. Typically, such utility poles are set at least six feet in the ground. Of course, the hole is much larger in diameter than the pole and therefore, dirt must be returned to the hole around the pole little by little and must be tamped or compacted tightly around the pole to provide vertical stability.

To ease the job of tamping the dirt tightly, hydraulic pole tampers are commonly used. The tool is often used by utility crews to back fill a hole after installing a new power pole or by farmers for tamping fill material around new fence posts.

The hydraulic pole tampers come in sizes from 60" to 85" in length. The tamper is a longitudinal tool with two hydraulic hoses connected to the top end, a hydraulic impact unit housed in a long thin body, and a ram head at the bottom. The driving fluid may be air or oil depending upon the application. In some applications an electric motor driven tamper may be used for tamping. However, in the instant application, the driving fluid is hydraulic oil supplied by a reservoir on a vehicle such as a truck which usually includes a hydraulic oil fluid driven derrick or other drilling equipment for setting posts in holes. Without driving fluid and the hoses, the tool weights often weight nearly 30 pounds.

DESCRIPTION OF THE RELATED ART

Several tampers are available on the market and typically include a drive having an output shaft, a housing connecting to the drive, and at least a portion of the output shaft extends into the housing. A camming member is attaches to the output shaft. A connecting rod is provided having a first end portion which extends into the housing wherein the first end portion includes an opening. A second end portion of the connecting rod extends out of the housing. The camming member is movably connected to the first end portion. The cam is at the opening. The output shaft is spaced from the opening. The output shaft extends through the opening. A tamper is connected to the second end portion of the connecting rod. The tamper often comprises a base member or shoe of a particular shape such as an oval or curved oval member.

A typical tamper device is disclosed in U.S. Pat. No. 8,414,221 by Faucher et al. For a "Tamper Device" which is incorporated by reference herein. The tamper device includes a housing, a drive connected the housing, a tamper adapted to reciprocate relative to the housing and apply pressure to a surface, and a wobble connection between the drive and the tamper, wherein the wobble connection comprises a wobble plate, and wherein a first end portion of the tamper is at a side of the wobble plate. The tamper device includes a housing, a drive, a tamper, and a wobble connection. The drive is connected the housing and the tamper is adapted to reciprocate relative to the housing and apply pressure to a surface such as dirt or rock. The wobble connection is between the drive and the tamper, wherein the wobble connection includes a wobble plate with a first end portion of the tamper is at a side of the wobble plate. More particularly, the tamper device includes a housing, a rotatable shaft, a camming member, a connecting rod, and a tamper wherein the rotatable shaft has a first end and a second end. The first end is adapted to be connected to a drive and the second end extends into the housing whereby the camming member is connected to the rotatable shaft. The connecting rod has a first end portion including an opening having a camming member located therein. The first end portion is between and spaced from the first end and the second end of the rotatable shaft. The tamper is connected to a second end portion of the connecting rod. As shown in the figures, the handle is consists of the upper end of the elongated conduit member.

U.S. Pat. No. 7,540,336 by Steffen describes a vibration isolator for a pneumatic pole or backfill tamper and which is incorporated by reference herein in its entirety suitable for cooperative engagement and mounting a handle kit assembly in accordance with the instant invention. The backfill tamper comprises a handle having a lower end; an elongated conduit member having a lower end and an upper end that is coupled to the lower end of the handle; a piston disposed in the conduit member; a rod coupled to the piston and having a lower end that extends out of the lower end of the conduit member, wherein the piston and rod are configured to reciprocate up and down together in the conduit member; a spring disposed in the conduit member between the piston and the lower end of the conduit member, the spring configured to bias the piston away from the lower end of the conduit member; and a percussion generating mechanism having an upper end coupled to the lower end of the rod, wherein the percussion generating mechanism is configured to receive a supply of pressurized air and convert the supply of pressurized air into a reciprocating percussive force; and a supply of pressurized air configured to flow through the conduit member to the percussion generating mechanism, wherein the supply of pressurized air biases on the piston against the bias of the spring; wherein feedback from the reciprocating percussive force of the percussion generating mechanism causes the rod and piston to reciprocate up and down in the conduit member such that the direction of the feedback and the reciprocation of the rod and piston remain in phase with each other; and wherein the reciprocating movements of the rod and piston are dampened by the counteracting forces of the spring and the supply of pressurized air to thereby limit transfer of feedback from the percussion generating mechanism to the handle. In addition, the piston may seal with the interior of the conduit member and divides the interior of the conduit member into upper and lower chambers that change in size as the piston and rod reciprocate up and down in the conduit member. The supply of pressurized air, oil or other fluid flows through the rod to the percussion generating mechanism. The rod may include an aperture through which the pressurized fluid passes via the rod from the conduit member to the rod. The rod may also include an aperture through which the pressurized air passes from the conduit member to the percussion generating mechanism. When the percussion generating mechanism is not operating, the pressurized air causes the rod to advance out of the lower end of the conduit member until an equilibrium state is reached between the pressurized fluid acting on the piston and the spring acting on the piston. A spring disposed between the upper end of the conduit member and the piston can be configured to prevent the piston from engaging the upper end of the conduit member during reciprocation. A second spring can be disposed between the lower end of the conduit member and the piston, the second spring configured to prevent the piston from engaging with the lower end of the conduit member during reciprocation. A shoe may also be coupled to the lower end of the percussion generating mechanism, the shoe configured to engage a tamping surface and transfer percussive force from the percussion generating mechanism to a tamping surface. However as shown in the figures, the conventional handle consists of the upper end of the elongated conduit member which includes connection means such as nipples or other fittings for comparatively engaging one or more hoses from a pressurized fluid generating unit such as a compressor or pump. An electric motor can also be used to power a pole tamper wherein an electric cord extends from a source of electricity such as a generator and attaches to a the upper end of the elongated conduit member.

The tamper tools work on the same principal as an impact hammer or a jack hammer and therefore is subjected to many intense vertical impacts and lots of jarring and shaking. Consequently, the hoses will become strained and will crack or break loose at the connections at the top of the tool as the tool is used. Failure of the hose causes a loss of hydraulic oil which is a safety concern in that the operator can be sprayed with hot hydraulic oil. Further negative issues associated with failed hoses include expensive downtime and repair and replacement of expensive parts in addition to environmental problems.

Another downside to the design of the tamping tool relates to the lack of a comfortable and easy to use handle. Conventional longitudinal tamping tools must be long and slender to fit into the bottom of a post hole. The tamping tools are typically hand held by the rounded vertical cylindrical housing as one wood hold a broom handle. Use of the tool includes lifting and moving the tool around the pole at various positions to tamp the fill dirt and rock around the pole. The tamper is then moved and lifted from the hole so additional fill material can be added to the hole to be tamped tight. Thus, the hole containing the pole is filled and tamped in layers a few inches at a time to insure the fill material is tight around the pole and edges of the hole. After extended use, the vibration together with the holding, raising and using this heavy tool along with the hydraulic hoses becomes strenuous and burdensome to a user.

Another post hole tamping device is available from Greenlee Utility Company as set forth in FIG. 1 as ("PRIOR ART"); however, none of the references provide the handle and adapter improvements made to manipulate the device as set forth in the instant invention. The Greenlee Fairmont hydraulic pole tamper includes a kidney shaped foot or base member. The tool is includes an open an d close center with the valve location at the end of the hose. The flow range of hydraulic fluid is from 4 to 6 gallons per minute and the operating pressure is from 1000 to 2000 psi. The foot size is 2.5×8 inches. The tamper rate of tamping is 1, 160 blows per minute at 5 gallon per minute flow rate.

Other tamper references which may be considered pertinent to examination of the application include U.S. Pat. No. 3,857,448; U.S. Patent Publication 200120312572), (U.S. Pat. Nos. 8,414,221); and 8,161,604.

SUMMARY OF THE INVENTION

A hydraulic pole tamper handle assembly for cooperatively engaging an elongated conduit member of a hydraulic pole tamper comprising an upper end defining an elongated conduit member including means for cooperatively engaging a pair of hydraulic hoses or an electric cord extending upward from a housing, a drive connected the housing, a tamper adapted to reciprocate relative to the housing and apply pressure to a surface, and a wobble connection between the drive and the tamper, wherein the wobble connection comprises a wobble plate, wherein a first end portion of the tamper is at a side of the wobble plate adapted to reciprocate relative to the housing and apply pressure to a surface such as dirt or rock. The hydraulic pole tamper handle assembly comprises, consists essentially of or consists of a handle frame comprising a pair of spaced apart aligned longitudinal arms extending upward from means for mounting to the upper end of the elongated conduit member of the pole tamper, the means for mounting extending around and shielding at least a portion of the means for connecting the hydraulic hoses or the electric cord to the upper end of the elongated conduit member, the longitudinal arms having a top distal end connecting to a handle grip member extending there between. Holding means attaches to the longitudinal arms at a position above the means for connecting the hydraulic hoses or the electric cord for removably securing the hydraulic hoses or the electric cord in vertical alignment with the upper end of the elongated conduit member of the pole tamper. The means for connecting a pair of hose connections of the hydraulic hoses comprises a spring loaded quick connect couplings affixed to the distal end of the hydraulic hose for cooperatively engaging a nipple extending from the upper end of the elongated member of the pole tamper. The means for mounting to the upper end of the elongated conduit member of the pole tamper comprises an open ended cylindrical base defining a sleeve having a diameter sized for coaxial engagement with the upper end of the elongated conduit member of the pole tamper, the sleeve including at least one apertures therein for insertion of the hydraulic hoses or the electric cord extending from the upper end of the elongated member of the pole tamper conduit for protecting the hoses and the user from leaking fluid should one of the hose connections leak or break. Another means for mounting to the upper end of the elongated conduit member of the pole tamper may also comprise at least one split ring defining a collar comprising two semicircular portions adjustably held together by set screws, the collar affixed to a bottom distal end of the longitudinal arms having a diameter sized for coaxial engagement with the upper end of the elongated conduit member of the pole tamper. The holding means attaching to the longitudinal arms at a position above the means for connecting the hydraulic hoses or the electric cord in vertical alignment with the upper end of the elongated conduit member of the pole tamper can comprise a fastener attaching a clamp affixed to the hose or the electric cord to a brace extending between a pair of cross members joining the longitudinal arms. Another holding means attaches to the longitudinal arms at a position above the means for connecting the hydraulic hoses or the electric cord in vertical alignment with the upper end of the elongated conduit member of the pole tamper comprises a holding block having a split body and through bores or channels for removably securing hoses therein, holding block including a pair of set screws for holding cooperatively engaging halves of the hold block together with the hoses held there between, the holding block affixed to a cross member extending between the longitudinal arms of the handle frame. The handle grip member comprises a straight cylindrical member or downward curved member connecting the longitudinal arms.

As shown in the figures, the handle assembly comprises, consists essentially of or consists of a handle member supported by a frame including a pair of spaced apart, parallel, longitudinal straps of metal extending from attachment means comprising a sleeve, collar, or ring members in coaxially and cooperatively engaging of the upper end of the elongated conduit member.

In accordance with the present invention, there is provided a pole tamper handle assembly for removable attachment to a hydraulic pole tamper having an upright longitudinal cylindrical housing including a hydraulic impact unit with a hydraulic cylinder and piston and two hydraulic hoses. The piston extends from the bottom of the hydraulic impact unit and has a tamper head fixedly attached thereto. The two hydraulic hoses are fluidly attached to the top end of the hydraulic impact unit. The handle assembly includes hose mounting means such as hose clamps secured to a handle assembly frame. The handle frame is fixedly connected to the top of the longitudinal cylindrical housing by handle attachment means such as a collar, sleeve, cylinder, or rings which fit coaxially around the upper conduit portion of the pole tamper and are secured thereto by bolts, set screws, welding, rivets, or by friction fit.

The hand frame includes a horizontal handle, an open ended cylindrical base with the first open end at the top of the cylindrical base and the second open end at the bottom of the cylindrical base. The cylindrical base has a diameter sized to fit down onto a top of the longitudinal cylindrical housing. The handle has two ends, the first end of the handle connected to a top edge of the cylindrical base by a first longitudinal strip and the second end of the handle connected to the top edge of the cylindrical base by a second longitudinal strip at a point opposite of the first longitudinal strip. The first and the second longitudinal strips have a gap there between which is bridged by a cross member having two apertures formed therein. The cylindrical base has two apertures formed in the sidewalls thereof. Also included are two hydraulic hose clamps including elastomeric bushings; and two fasteners capable of fastening the two hydraulic hose clamps with hoses into the two apertures formed within the cross member.

The present invention comprises or consists of a hydraulic pole tamper and handle frame assembly for a hydraulic pole tamper having an upper end defining an elongated conduit member including means for cooperatively connecting a pair of hydraulic hoses extending upward from a housing, a drive connecting the housing, a tamper adapted to reciprocate relative to the housing
and apply pressure to a surface, and a wobble connection between the drive and the tamper, wherein the wobble connection comprises a wobble plate, wherein a first end portion of the tamper is at a side of the wobble plate adapted to reciprocate relative to the housing and apply pressure to a surface such as dirt or rock. The removable handle assembly cooperatively engages the elongated conduit member of the hydraulic tamper pole and comprises a handle frame having a pair of spaced apart aligned longitudinal arms extending upward from removable means for mounting coaxially affixed to and mounted on an upper end of the elongated conduit member of the pole tamper. A removable means for mounting extends around and shields at least a portion of the means for connecting the hydraulic hoses to the upper end of the elongated conduit member. The longitudinal arms have a pair of spaced apart aligned distal ends connecting to a handle grip member extending there between. Holding means attaches to the longitudinal arms at a position above the means for connecting the hydraulic hoses for removably securing the hydraulic hoses in vertical alignment with the upper end of the elongated conduit member of the pole tamper. The removable means for mounting has a diameter sized and shaped for coaxial engagement with the upper end of the elongated conduit member of the pole tamper. The removable means for mounting extends around and shields at least a portion of the means for connecting the hydraulic hoses to the upper end of the elongated conduit member. The handle frame assembly includes at least one cross member disposed between the longitudinal arms at a position above the means for connecting and removably securing the hydraulic hoses. Hydraulic hose holding means attach to the at least one cross member for holding the hydraulic hoses in vertical alignment with the upper end of the elongated conduit member of the pole tamper. The hydraulic hose holding means attaches to the handle frame at a position above the sleeve, and the hydraulic hoses extending through an upper end of the sleeve removably attaching to the hydraulic hoses means. The means for connecting a pair of hose connections of the hydraulic hoses comprises a spring loaded quick connect couplings affixed to the distal end of the hydraulic hose for cooperatively engaging a nipple extending from the upper end of the elongated conduit member of the pole tamper. A holding means comprises a block including cylindrical through holes mounting to the cross member. The handle grip member comprises a straight cylindrical member connecting the longitudinal strips or a curved member attachable to or integrally formed with the longitudinal strips. The cylindrical base means for mounting is at least one and preferably at least two spaced apart split rings defining collars having semicircular portions adjustably held together by set screws, with the collar affixed to a bottom distal end of the longitudinal arms having a diameter sized for coaxial engagement with the upper end of the elongated conduit member of the pole tamper.

It is an object of this invention to provide a hydraulic pole tamper with an easy to grip handle at the top end which includes a generally cylindrical handle member adjoining a pair of side arms comprising longitudinal members or straps extending downward for cooperatively engaging an upper distal end of a longitudinal cylindrical body or shaft of a pole tamper.

It is an object of this invention to provide a hydraulic pole tamper including hose clamps with elastomeric bushings to cushion the hydraulic hoses against the shock of the hydraulic pulses causing the intense longitudinal thrusts of the tamper head.

It is another object of this invention to provide a hydraulic pole tamper wherein the D-grip handle is part of a handle frame which also includes apertures for the attachment of hose clamps.

It is another object of the present invention to provide a more ergonomic handle easier to grip and control the tamper.

It is another object of the present invention to provide a handle enabling the user to control the orientation of the tamper.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
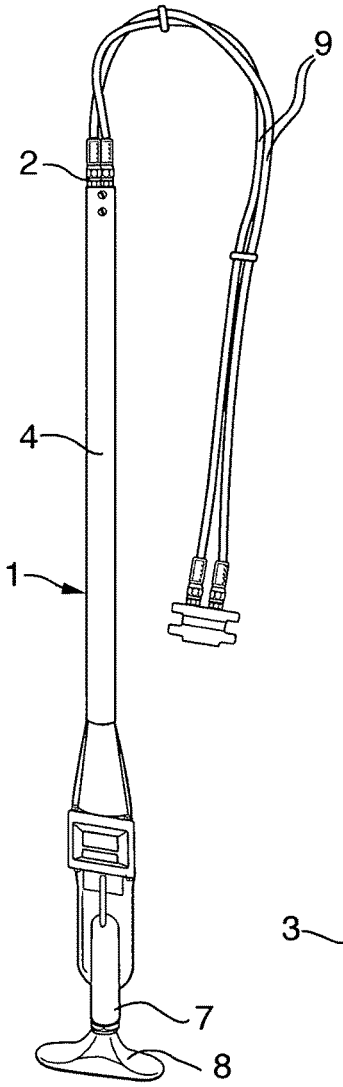
FIG. 1 PRIOR ART
FIG. 1 is a perspective view of a conventional hydraulic pole tamper.
Figure 2:
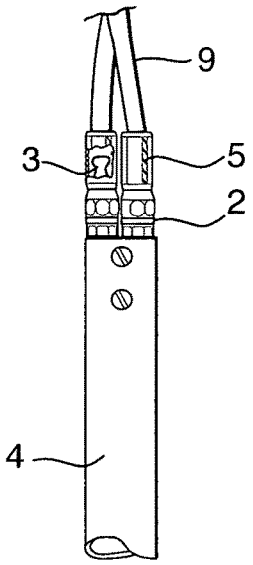
FIG. 2 is an enlarged perspective view of the hydraulic hose connections to the pole tamper of FIG. 1, showing a pair of threaded couplings attaching the hoses connecting to quick disconnect couplings such as HANSON fittings which cooperatively engage nipples extending from the top distal end of the pole tamper.
Figure 3:
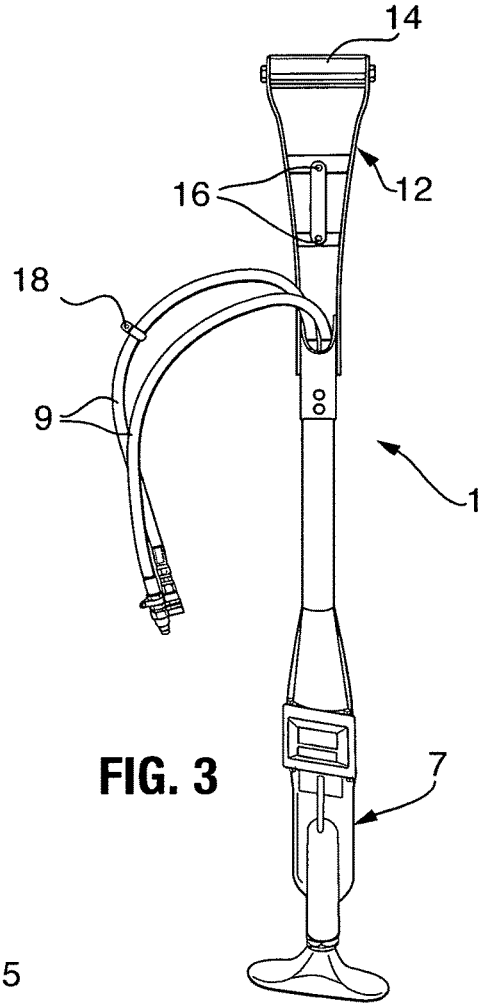
FIG. 3 is a front perspective view of the pole tamper including the handle and adapter assembly including the handle frame and hose clamp improvements.
Figure 4:
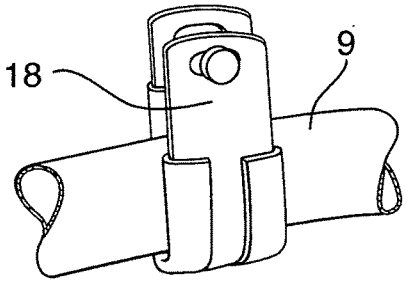
FIG. 4 is an enlarged in view of the hose clamp with the elastomeric bushing.
Figure 5:
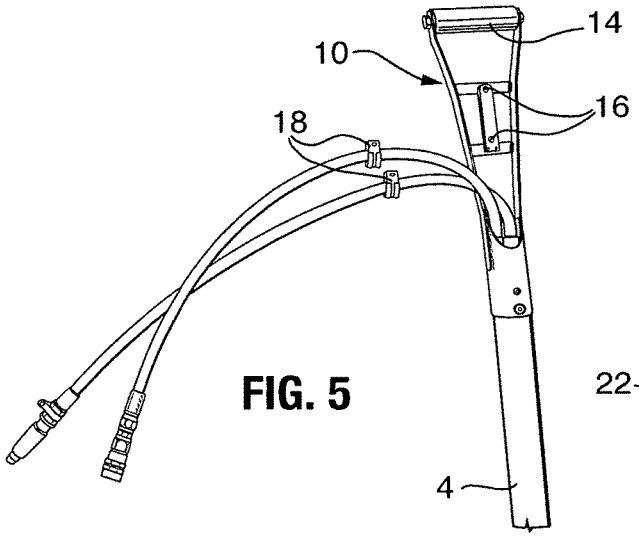
FIG. 5 is an enlarged perspective view of the pole tamper showing the HANSON fittings quick disconnect fittings on the distal ends of the hydraulic hoses extending from the pole tamper hoses.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In accordance with the present invention, there is provided a hydraulic pole tamper 10 as shown in FIGS. 1-10. The pole tamper 1 as shown in the figures include a longitudinal cylindrical body 4, a tamper head 8 at the bottom end, two hydraulic hoses 9. The improvement comprises the a handle assembly 10 having a frame 12 including a handle grip 14 at the top end with hydraulic hose clamps holding brackets 16 for attachment of hose clips 18 mounting to the hoses 9 for removably mounting the hoses 9 in spaced apart alignment. The nipples 3 extending from the distal end of the upper end of the elongated conduit member 4 from a hose junction 2 are connected to spring loaded quick disconnect couplings 5 such as HANSON fitting attaching to the distal end of the hoses 9. The upper end of the elongated conduit member defining a longitudinal cylindrical body 4 includes a hydraulic impact unit 7 including a hydraulic cylinder and piston assembly 8 and base tamping member or foot 8.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 7:
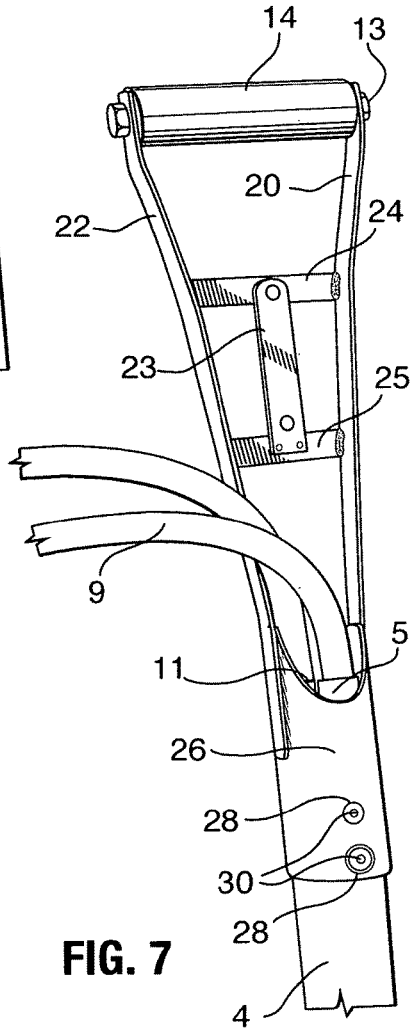
FIG. 7 is an enlarged view of the upper portion of the modified handle and frame assembly mounted to a hydraulic pole tamper showing the attachment and fasteners fixing the lower cylindrical portion of the handle frame distal end of the upper conduit or shaft of pole tamper.
Figure 10:
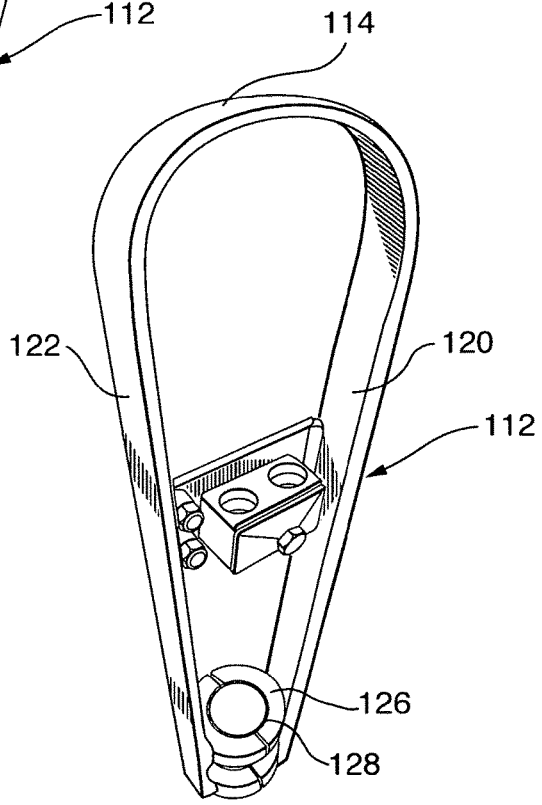
FIG. 10 is a perspective view of the pole tamper handle assembly having a curved ergonomic handle.

The handle assembly 12 kit for the pole tamper 1 includes handle frame 12 and handle grip 14 connected to the upper end of the elongated cylindrical body 4. The handle assembly 10 includes a frame 12 comprising a pair of elongated spaced apart aligned longitudinal straps or arms 20 and 22 extending upward from a cylindrical attachment base defining a sleeve 26 which coaxially and cooperatively engages the upper end of the elongated conduit member 4 of the pole tamper 1. It is contemplated that the cooperatively engaging member can comprise straps or another portion of the frame extending downward for fixed engagement with the conduit member 4 and held thereto by rivets, bolts, clamps, or a friction fit. The cylindrical base 26 has at least a bottom portion with an inner diameter large enough to firmly slide down over the top end of the longitudinal cylindrical housing 4. Original equipment manufactures may also weld the base of the handle assembly to the conduit member 4. As shown in the drawings the frame members 22,24 diverge or spread apart. The frame members 122, 124 may be formed of straight longitudinal members and spread apart at a selected angle to converge at the upper distal end for joining by a downwardly curved handle grip member 114 as shown in FIG. 10; or the frame members 22, 24 may diverge at inwardly and outwardly at selected positions to provide attachment points and an upper end which terminates at an handle grip portion 14 which comprises a generally straight cylindrical member at a top distal end extending across and joining frame arms 20 and 22 as shown in FIG. 7. The handle grip portion 14, 114 may be affixed to the frame arms 22, 24 by bolts, pins, welding, friction fit or other attachment means or be formed as an integral portion of the frame 12 as shown in FIG. 10.

As shown in FIGS. 1-10, the pair of vertically oriented longitudinal members or arms 20, 22 extend upward from the cylindrical sleeve 26 which slides over and cooperatively engages the pole tamper cylindrical body 4. The members 20, 22 are spread apart at a selected acute angle for connecting to a handle grip member 14 of a selected length to enable the user to twist the handle grip and control the orientation of the foot shaped tamper or shoe 8 and to twist the pole tamper 1 or lift it in and out of the hole. The sleeve 26 may comprise a solid member include apertures therein. At least a portion of the top end or a side must include an opening 11 large enough to accommodate connection of the hoses to the nipples or threaded end members 3 extending upward from the hose junction 2 of the distal end of the pole tamper conduit 4. An important consideration is the capability of the sleeve 26 to protect the hose connection fittings and protects the user from leaking fluid should one of the hose connections leak or break.

As shown in FIGS. 3 and 5-10, holding means 13 such as a rods, pins, bolts, or welding connects the handle grip member 14 to the distal ends of the arm members 20 and 22 or the handle grip member 14 can be formed integral with the arms 22 and 24. The side members 20 and 22 are connected at the ends of the handle 14 and taper downward to the top circular edge of cylinder 26. A pair of cross members 24, 25 extend between the arm members 20 and 22 at selected points to provide lateral stability for the frame 12 and attachment points for the hose clips 18 in order to hold the distal ends of the hose 9 in vertical alignment for attachment to the nipples 3 of the pole tamper 1 eliminating stress on the hoses and connection points due to the weight of the hoses during use.

Figure 6:
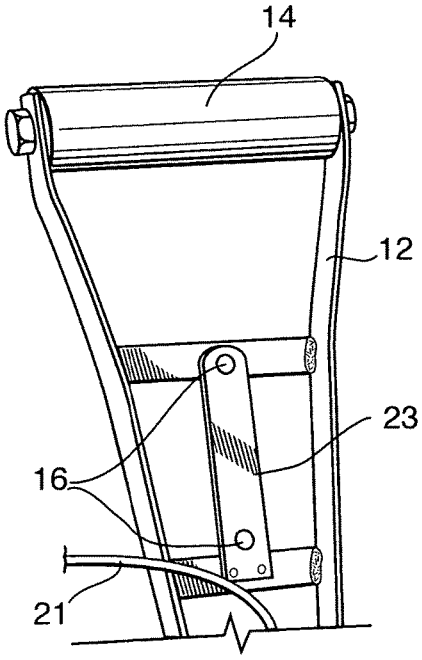
FIG. 6 is an enlarged view of the upper portion of the handle and adapter frame including cross members and brace including the apertures for attachment of at least one clamp for securing an electric cord in electrical communication with a pole tamper and an electric power source.

The cross member 24, 25 as shown in the FIG. 6, includes at least one vertical brace 23 connecting the two spaced apart cross members 24 and 25 stretching from side member 20 to side member 22. A cross members 24, 25 and/or brace 23 includes clamp holding means 16 defining apertures located at the junction of the center member 23 and the cross member braces 24 and 25, for the purpose of attaching hose clamps 18. While the holding means 16 in the instant embodiment is provided by the cross members 24 or 25 or brace 23, it is contemplated that a loop, hook, flange, or other projection can be affixed by bolts or welding to a longitudinal arm 20, 22, 120, 122 providing a support for affixing the hose clamps 18 thereto. As shown, the upper portion of the handle and adapter frame include cross members and a brace for attachment of at least one clamp for securing an electric cord 21 in electrical communication with an electric pole tamper and an electric power source.

Figure 8:
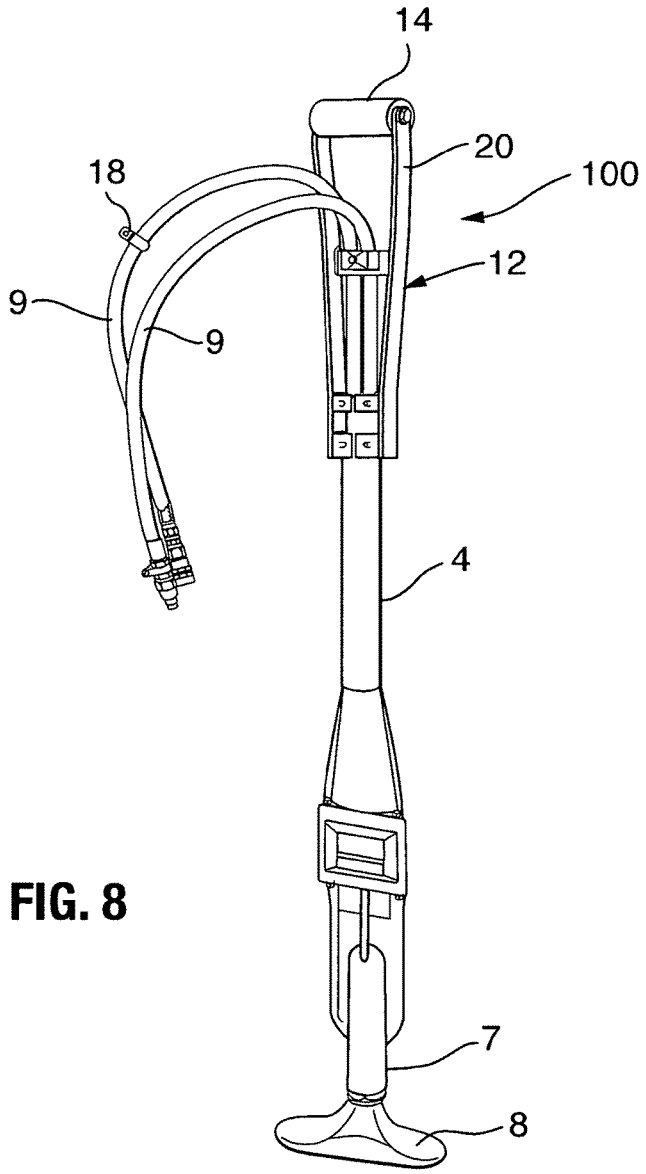
FIG. 8 is a perspective view of the handle assembly kit showing the handle and frame mounting to the upper portion of the pole tamper including an alternate hose clamp design for utilizing set screws to removably secure the hoses immovably within a holding block mounted to the frame and an a pair of attachment rings or collars having set screws to removably attach the lower portion of the handle frame to the cylindrical upper body handle portion of a conventional tamper.
Figure 9:
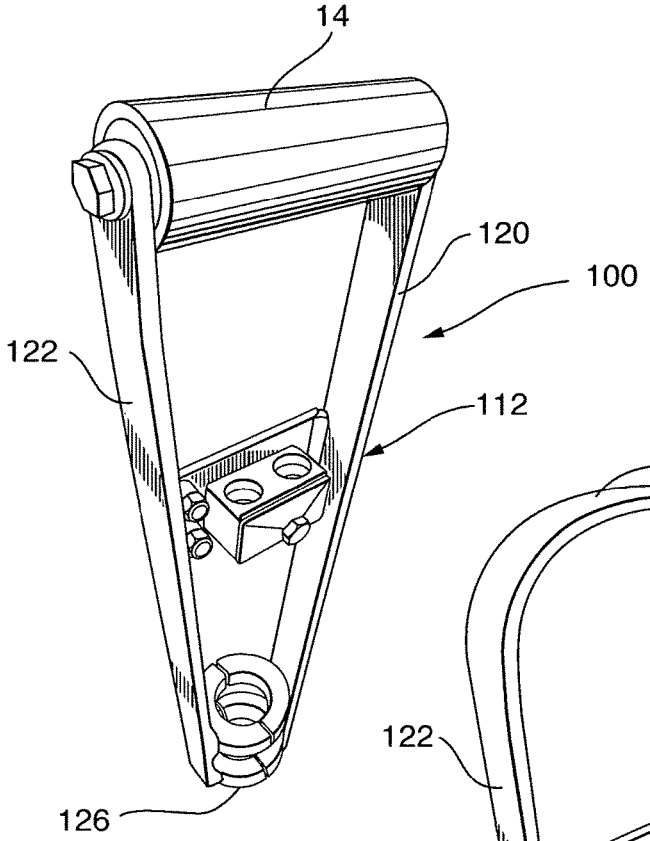
FIG. 9 is an enlarged perspective view of a handle assembly adapter kit including the handle and attachment frame including ring clamps for attachment to the upper end of the elongated conduit member of the pole tamper and a hose retaining or holding block.

FIGS. 8-10 show embodiments of the handle assembly 100 frame including a frame 112 and handle grip portion 114. At least one cross member 124 comprising a metal strip connects longitudinal arms 20 and 22 as shown in FIG. 8 and longitudinal arms 120 and 122 as shown in FIGS. 9 and 10.

Two apertures 28 are present in the sidewall of the cylindrical base 26 for fasteners such as screws 30 which rigidly hold the handle frame 12 to the top of the cylindrical housing 4.

Two hose clamps 18 are included and used to fasten the hydraulic hoses 9 to the handle frame 12 for lateral support. The hose clamps 18 include elastomeric bushings 19 to cushion the hoses 9. The clamps 18 are fastened to the handle frame 12 at the apertures 16 with fasteners such as screw and nut combinations. The clamps enable the hose to bent at a 90 degree angle at a section of the hose other than the distal end connecting to the hydraulic tamper connections. Constant vibration and twisting tends to weaken the hoses at the connection joint to the fittings with conventional tamper tools because the connection point and the bending point are at the same junction which leads to premature failure of the connections and hoses, damage to same, downtime, and potential hazards to the tamper user. Applicants improved orientation handle and design minimize the stress on the hoses, the fittings, and the worker orienting and lifting the tamper during use.

As shown in FIGS. 8 and 9, the present embodiment can be made available as a kit to retrofit an existing conventional pole tamper wherein the handle is defined by a cylindrical shaft extending upward from the tamping unit. The handle kit 100 includes a generally cylindrical handle 14 which may include a straight handle grip portion 14 or a curved handle grip portion 114 to forming a loop handle. The embodiments shown in FIGS. 8-10 include a hose retaining or holding block 116 having vertical oriented through bores 117 there through. The holding block 116 is attached to a brace 123 by screws or welding and extends between the longitudinal arms 120 and 122. The holding block comprises two portions which are split providing means for insertion of the hose therein and holding the hoses in position with respect to the handle frame 112.

Means for removably mounting to the upper end of the elongated conduit member of the pole tamper comprises at least one split ring defining a collar 126 comprising two semicircular portions adjustably held together by set screws. The collar is affixed to a bottom distal end of the longitudinal arms having a diameter sized for coaxial engagement with the upper end of the elongated conduit member of the pole tamper. One preferred embodiment includes a pair of spaced apart collars or split ring members 102 and 104 are disposed between the proximate ends of the longitudinal arms 120 and 122 forming the lower portion of the handle body. The rings 102 and 104 clamp the handle frame 112 to the upper longitudinal conduit 4 of the post tamper 1. A cylindrical sleeve 128 may optionally be inserted between the collar 126 and conduit 4 providing a protective shield against leaking hydraulic fluid from a broken line.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A hydraulic pole tamper handle and adapter for a hydraulic pole tamper comprising an elongated conduit member extending from a longitudinal cylindrical housing and including means for cooperatively connecting a pair of hydraulic hoses extending upward from said longitudinal cylindrical housing, a drive connecting said longitudinal cylindrical housing to a tamper adapted to reciprocate relative to said housing and apply pressure to a surface, and a wobble connection between said drive and said tamper, wherein said wobble connection comprises a wobble plate and is adapted to reciprocate relative to said longitudinal cylindrical housing, applying pressure to compact a surface such as dirt or rock:

an improvement consisting of:

a removable handle frame adapter fixedly connected to a top of said longitudinal cylindrical housing, said removable handle frame adapter including a horizontal handle grip member, an open ended cylindrical base with a first open end at a top of said cylindrical base and a second open end at a bottom of said cylindrical base, said cylindrical base having a diameter sized to fit down onto a top of said longitudinal cylindrical housing, said handle having two ends, a first end of said handle connected to a top edge of said cylindrical base by a first longitudinal strip, a second end of said handle connected to a top edge of said cylindrical base by a second longitudinal strip at a point opposite of said first longitudinal strip, said first and said second longitudinal strips having a gap there between, said gap being bridged by a cross member, said cross member including at least a pair of apertures formed therein;

two hydraulic hoses cooperatively engaging said at least a pair of apertures;

retainer means for fastening said two hydraulic hose clamps with hoses to said cross member; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

2. The hydraulic pole tamper handle assembly of claim 1, wherein a holding means comprises a block including cylindrical through holes mounting to said cross member.

3. The hydraulic pole tamper handle assembly of claim 1, wherein said handle grip member comprises a straight cylindrical member connecting said longitudinal strips.

4. The hydraulic pole tamper handle assembly of claim 1, wherein said handle grip member comprises a downward extending curved member connecting said longitudinal arms.

5. The hydraulic pole tamper handle assembly of claim 1, wherein said means for mounting to said upper end of said elongated conduit member of said pole tamper comprises at least one split ring defining a collar comprising two semicircular portions adjustably held together by set screws, said collar affixed to a bottom distal end of said longitudinal arms having a diameter sized for coaxial engagement with said upper end of said elongated conduit member of said pole tamper.

6. The hydraulic pole tamper handle assembly of claim 1, wherein said means for mounting to said upper end of said elongated conduit member of said pole tamper comprises at least a pair of spaced apart split rings defining a pair of aligned collars comprising two semicircular portions adjustably held together by set screws, said collar affixed to a bottom distal end of said longitudinal arms having a diameter sized for coaxial engagement with said upper end of said elongated conduit member of said pole tamper.

7. The hydraulic pole tamper handle assembly of claim 1, including a cylindrical sleeve disposed between a top distal end of said longitudinal cylindrical housing and said cylindrical base.

8. A hydraulic pole tamper and handle frame assembly comprising:

a hydraulic pole tamper comprising an elongated conduit member extending from a housing and including means for cooperatively connecting a pair of hydraulic hoses extending upward from said housing, a drive connecting said housing to a tamper adapted to reciprocate relative to said housing and apply pressure to a surface, and a wobble connection between said drive and said tamper, wherein said wobble connection comprises a wobble plate and adapted to reciprocate relative to said housing applying pressure to compact a surface such as dirt or rock;

said removable handle frame assembly attaching to a top portion of said upper end of said elongated conduit member, said removable handle frame assembly including a handle frame comprising a pair of spaced apart aligned longitudinal arms extending upward from a bottom portion and including removable means for mounting comprising a cylindrical base attaching to said elongated conduit member, said longitudinal arms including an upper portion having a pair of spaced apart aligned distal ends connecting to a handle grip member extending there between, said cylindrical base including a first open end at a top of said cylindrical base and a second open end at a bottom of said cylindrical base, said cylindrical base having a diameter sized and shaped for coaxial engagement with said upper end of said elongated conduit member of said pole tamper, said cylindrical base extending around and shielding at least a portion of said means for connecting said hydraulic hoses to said upper end of said elongated conduit member, said removable handle frame assembly including at least one cross member disposed between said longitudinal arms at a position above said means for removably securing said hydraulic hoses, and hydraulic hoses holding means attaching to said at least one cross member for holding said hydraulic hoses in vertical alignment with said upper end of said elongated conduit member of said pole tamper, said hydraulic hoses holding means attaching to said handle frame at a position above said cylindrical base, and said hydraulic hoses extending through an upper end of said cylindrical base removably attaching to said hydraulic hoses holding means; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

9. The hydraulic pole tamper handle assembly of claim 8, wherein a holding means comprises a block including cylindrical through holes mounting to said cross member.

10. The hydraulic pole tamper handle assembly of claim 8, wherein said handle grip member comprises a straight cylindrical member connecting said longitudinal strips.

11. The hydraulic pole tamper handle assembly of claim 8, wherein said handle grip member comprises a downward extending curved member connecting said longitudinal arms.

12. The hydraulic pole tamper handle assembly of claim 8, wherein said cylindrical base means for mounting comprises at least one split ring defining a collar comprising two semicircular portions adjustably held together by set screws, said collar affixed to a bottom distal end of said longitudinal arms having a diameter sized for coaxial engagement with said upper end of said elongated conduit member of said pole tamper.

13. The hydraulic pole tamper handle assembly of claim 8, wherein said means for mounting to said upper end of said elongated conduit member of said pole tamper comprises at least a pair of spaced apart split rings defining a pair of aligned collars comprising two semicircular portions adjustably held together by set screws, said collar affixed to a bottom distal end of said longitudinal arms having a diameter sized for coaxial engagement with said upper end of said elongated conduit member of said pole tamper.

14. The hydraulic pole tamper handle assembly of claim 8, including a cylindrical sleeve disposed between a top, distal end of said longitudinal cylindrical housing and said cylindrical base.

15. A hydraulic pole tamper and handle frame assembly, comprising:

a hydraulic pole tamper comprising an upper end defining an elongated conduit member including means for cooperatively connecting a pair of hydraulic hoses extending upward from a housing, a drive connecting the housing, a tamper adapted to reciprocate relative to the housing and apply pressure to a surface, and a wobble connection between the drive and the tamper, wherein the wobble connection comprises a wobble plate, wherein a first end portion of the tamper is at a side of the wobble plate adapted to reciprocate relative to the housing and apply pressure to a surface such as dirt or rock; and a removable handle assembly for cooperatively engaging said elongated conduit member of said hydraulic tamper pole, comprising a handle frame comprising a pair of spaced apart aligned longitudinal arms extending upward from removable means for mounting coaxially affixed to and mounted on an upper end of said elongated conduit member of said pole tamper, said removable means for mounting extending around and shielding at least a portion of said means for connecting said hydraulic hoses to said upper end of said elongated conduit member, said longitudinal arms having a pair of spaced apart aligned distal ends connecting to a handle grip member extending there between, holding means attaching to said longitudinal arms at a position above said means for connecting said hydraulic hoses for removably securing said hydraulic hoses in vertical alignment with said upper end of said elongated conduit member of said pole tamper, said removable means for mounting having a diameter sized and shaped for coaxial engagement with said upper end of said elongated conduit member of said pole tamper, said removable means for mounting extending around and shielding at least a portion of said means for connecting said hydraulic hoses to said upper end of said elongated conduit member, said handle frame assembly including at least one cross member disposed between said longitudinal arms at a position above said means for connecting and removably securing said hydraulic hoses, and hydraulic hoses holding means attaching to said at least one cross member for holding said hydraulic hoses in vertical alignment with said upper end of said elongated conduit member of said pole tamper, said hydraulic hoses holding means attaching to said handle frame at a position above said sleeve, and said hydraulic hoses extending through an upper end of said sleeve removably attaching to said hydraulic hoses means; and said means for connecting a pair of hose connections of said hydraulic hoses comprising spring loaded quick connect couplings affixed to said distal end of said hydraulic hose for cooperatively engaging a nipple extending from said upper end of said elongated conduit member of said pole tamper.

16. The hydraulic pole tamper handle assembly of claim 15, wherein a holding means comprises a block including cylindrical through holes mounting to said cross member.

17. The hydraulic pole tamper handle assembly of claim 15, wherein said handle grip member comprises a straight cylindrical member connecting said longitudinal strips.

18. The hydraulic pole tamper handle assembly of claim 15, wherein said handle grip member comprises a downward extending unitary curved member connecting said longitudinal arms.

19. The hydraulic pole tamper handle assembly of claim 15, wherein said cylindrical base means for mounting comprises at least one split ring defining a collar comprising two semicircular portions adjustably held together by set screws, said collar affixed to a bottom distal end of said longitudinal arms having a diameter sized for coaxial engagement with said upper end of said elongated conduit member of said pole tamper.

20. The hydraulic pole tamper handle assembly of claim 15, wherein said means for mounting to said upper end of said elongated conduit member of said pole tamper comprises at least a pair of spaced apart split rings defining a pair of aligned collars comprising two semicircular portions adjustably held together by set screws, said collar affixed to a bottom distal end of said longitudinal arms having a diameter sized for coaxial engagement with said upper end of said elongated conduit member of said pole tamper.

21. The hydraulic pole tamper handle assembly of claim 1, including a cylindrical sleeve disposed between a top distal end of said longitudinal cylindrical housing and said cylindrical base.

* * * * *